United States Patent [19]

Dollhopf et al.

[11] Patent Number: 4,785,722

[45] Date of Patent: Nov. 22, 1988

[54] FUME HOOD WITH STEP BAFFLES

[75] Inventors: Norman K. Dollhopf, Sheboygan; Roger J. Duffek, Two Rivers, both of Wis.

[73] Assignee: Hamilton Industries, Two Rivers, Wis.

[21] Appl. No.: 78,594

[22] Filed: Jul. 28, 1987

[51] Int. Cl.[4] ..... F23J 11/00

[52] U.S. Cl. ..... 98/115.3

[58] Field of Search ..... 98/115.1, 115.3; 126/299 R, 299 D

[56] References Cited

U.S. PATENT DOCUMENTS

| | | | |
|---|---|---|---|
| 2,649,727 | 8/1953 | Snow et al. | 98/115.3 |
| 2,779,265 | 1/1957 | Liptay | 98/115.3 |
| 3,111,077 | 11/1963 | Cortright | 98/115.3 |
| 3,217,630 | 11/1965 | Katzfey et al. | 98/115.3 |
| 3,218,953 | 11/1965 | Grow et al. | 98/115.3 |
| 3,318,227 | 5/1967 | Nelson et al. | 98/115.3 |
| 3,593,646 | 7/1971 | Hauville | 98/115.3 |
| 3,604,333 | 9/1971 | Nelson | 98/115.3 |
| 3,747,504 | 7/1973 | Turko et al. | 98/115.3 |
| 3,747,505 | 7/1973 | Turko | 98/115.3 |
| 3,752,056 | 8/1973 | Chamberlin et al. | 98/115.3 |
| 4,177,717 | 12/1979 | Grow et al. | 98/115.3 |
| 4,211,155 | 7/1980 | Stoll et al. | 98/115.3 |
| 4,434,711 | 3/1984 | Zboralski et al. | 98/115.3 |

FOREIGN PATENT DOCUMENTS

| | | | |
|---|---|---|---|
| 2161261 | 1/1986 | United Kingdom | 98/115.3 |

*Primary Examiner*—Harold Joyce

*Attorney, Agent, or Firm*—Tilton, Fallon, Lungmus

[57] ABSTRACT

A fume hood having a step baffle system that improves uniformity of flow under different operating conditions, increases draw along the work surface, and, in general, enhances hood performance. An intermediate baffle plate of the baffle system may be pivotally mounted and may be associated with a remote-control mechanism for adjusting its operating position. A rectangular bell-mouth collar at the exhaust opening of the hood contributes in achieving a high level of hood efficiency and permits nearly vertical orientation of the fixed uppermost baffle plate, thereby providing greater work space within the upper portion of the hood chamber. Exhaust ports at the top corners of the upper baffle plate promote and control the vertical flow of gases in the upper portion of the hood chamber to aid in the evacuation of fumes from that region.

27 Claims, 3 Drawing Sheets

FUME HOOD WITH STEP BAFFLES

BACKGROUND AND SUMMARY

Laboratory fume hoods having adjustable baffle systems are well known as disclosed, for example, in co-owned U.S. Pat. Nos. 4,177,717, 4,434,711, 3,218,953, 3,217,630, 3,747,505, and 3,747,504. Typically, such a fume hood takes the form of a housing defining a chamber with an access and gas-inlet opening along the lower front portion of the hood. Baffles are arranged in a vertical series along the rear of the chamber, usually with the uppermost baffle or baffles sloping forwardly and, at least in some cases, substantially limiting work space within the upper portion of the chamber. Gases, as they are exhausted, are drawn through slots or openings between the successive baffle plates of the series, as well as about the side edges of those plates, and are carried upwardly behind the baffle plates into the exhaust opening. Other patents disclosing laboratory fume hood constructions are U.S. Pat. Nos. 3,604,333, 3,318,227, 3,111,077, 3,593,646, and 3,752,056.

It has been found that, in the operation of a typical laboratory fume hood of the type described, uncontrolled turbulence tends to develop in the upper portion of the hood chamber, and the extent of such turbulence varies with the positions of adjustment of the baffle plates, the extent of obstruction of the hood's front opening, and other factors. Such turbulence, and particularly the variability of such turbulence under different operating conditions, adversely affects uniformity of hood operation and the rate of evacuation of gases from the upper portion of the hood chamber.

The fume hood of this invention incorporates a baffle system that includes at least three baffle plates of generally rectangular configuration arranged in a stepped vertical series with their upper and lower edges spaced apart to define horizontal exhaust slots for the flow of gases from the chamber into the hood's exhaust opening. A pair of exhaust ports are provided at the top corners of the uppermost baffle plate to promote direction and control over the evacuation of gases circulating in the upper portion of the chamber. Specifically, air entering the hood through the inlet opening develops a vortical action that is given lateral direction as the spiraling gases travel towards the ports. Such gases continue through the ports and into the exhaust opening located centrally behind and above the upper baffle plate.

The upper and lower baffle plates of the series are fixed, but the intermediate plate may be either fixed or adjustable. If adjustable, the intermediate plate is mounted for pivotal movement about a horizontal line extending along its lower edge so that adjustment of the plate increases or decreases the size of the exhaust slot formed between the upper edge of the intermediate plate and the lower edge of the upper plate.

Unlike the upper baffle plate of a conventional hood, the fixed upper baffle plate of the hood disclosed herein is relatively vertical and provides greater space within the upper portion of the hood chamber. Gases are exhausted from the hood through a rectangular exhaust opening that has a forward-rearward dimension substantially the same as the distance between the upper baffle plate and the rear panel of the hood. A rectangular collar is externally mounted upon the hood and includes vertical front and rear walls that are aligned with the upper baffle plate and the hood's rear panel, respectively. The side walls of the collar curve downwardly and outwardly to merge with the hood's top panel, giving the hood a bellmouth configuration when viewed in transverse vertical section and promoting a smooth flow of gases through the rectangular exhaust opening. Because of its shape, the bellmouth collar may be installed by forming a rectangular notch in the top panel of the hood, thereby simplifying manufacture and installation, and avoiding potential problems of structural weakness that tend to be associated with the provision of circular exhaust openings.

Such a construction has been found to increase draw along the work surface and render it more uniform under various operating conditions. In general, fume capture within the hood is significantly enhanced and face velocities through the inlet or access opening of the hood may be maintained within a range of plus or minus 10% over the range of adjustment of the baffle system. Static pressure is also significantly reduced, resulting in appreciable savings in energy costs. Benefits from such a construction may also be realized even in those installations where the intermediate baffle plate is non-adjustable.

In a preferred embodiment, the intermediate baffle plate may be adjusted by an improved remote control mechanism. Such mechanism includes a knob-equipped control rod having multiple positions of adjustment that may be selected either visually (by color-coding for the different positions), or through tactile feedback, or both.

Other features, advantages, and objects will be apparent from the specification and drawings.

DRAWINGS

DETAILED DESCRIPTION OF PREFERRED EMBODIMENTS

Figure 5:
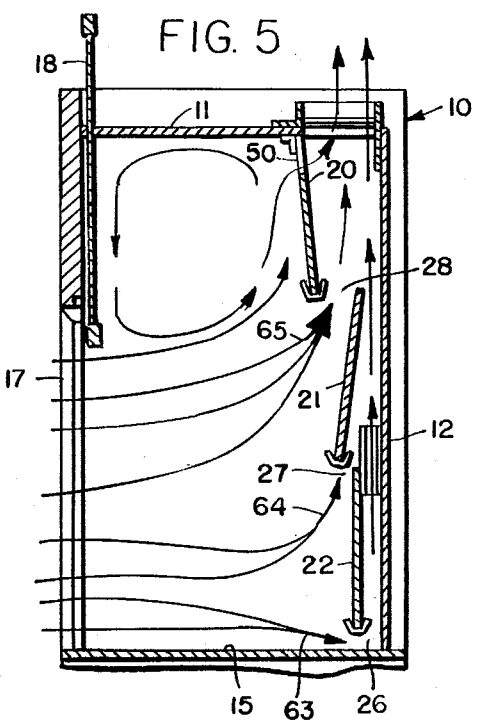
FIG. 5 is a vertical sectional view similar to FIGS. 3 and 4 but showing the intermediate baffle plate in a fully-opened position.
Figure 4:
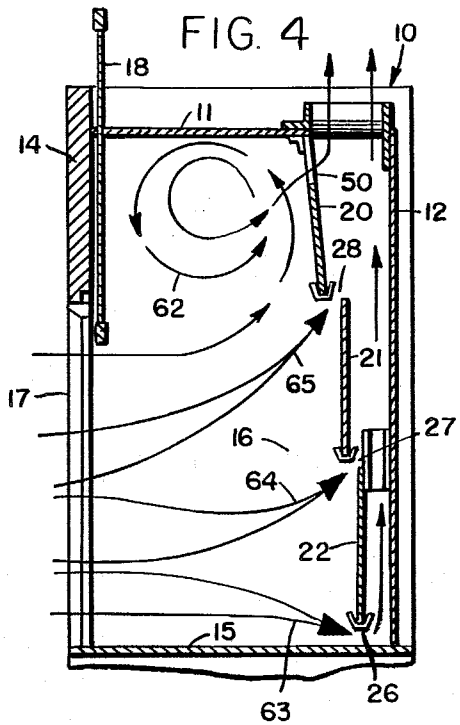
FIG. 4 is a sectional view similar to FIG. 3 but showing the intermediate baffle plate in a partially-open condition.
Figure 3:
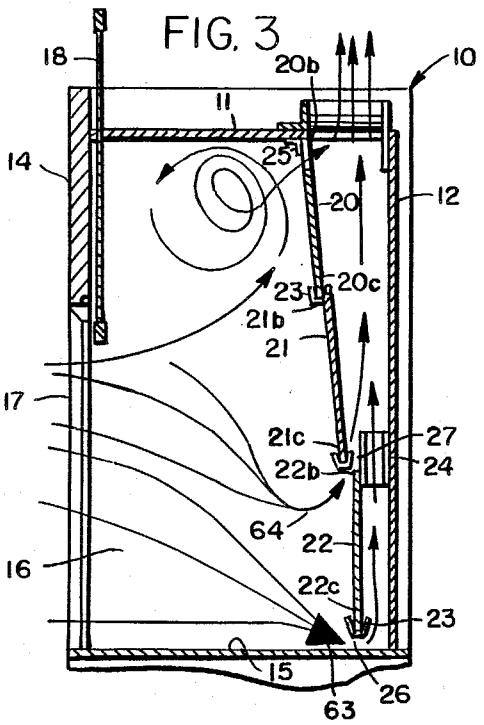
FIG. 3 is a vertical side sectional view illustrating flow paths when the intermediate baffle plate is in its closed position.

Referring to the drawings, the numeral 10 generally designates a fume hood including a housing having top, rear, side, and front panels 11–14, respectively. The hood may also include a bottom panel (FIG. 1) or, alternatively, the hood may be open at its lower end and adapted to rest upon the horizontal surface of a table, cabinet, or counter. In any event, the lower limits of the hood chamber are defined by a horizontal work surface 15. Between that surface and the lower limits of the front panel 14 is an access opening 17 that serves as an inlet for room air as well as providing access to the interior of the hood. The opening 17 may be closed by a conventional sash 18 which, in FIGS. 3–5 is depicted in its raised position. For details of sash construction, reference may be had to co-owned U.S. Pat. Nos. 4,385,551, 3,942,421, and 3,934,496.

Within the rear portion of the hood chamber is a series of generally vertical baffle plates 20, 21, and 22. While particularly effective results have been achieved using three such plates, as shown in the drawings, it is believed that a greater or smaller number might be used. For example, in a large walk-in hood, the baffle arrangement shown may be supplemented with an additional baffle plate positioned below plate 22 and stepped to define horizontal slots along its upper and lower edges as hereinafter described with respect to plate 22.

Figure 1:
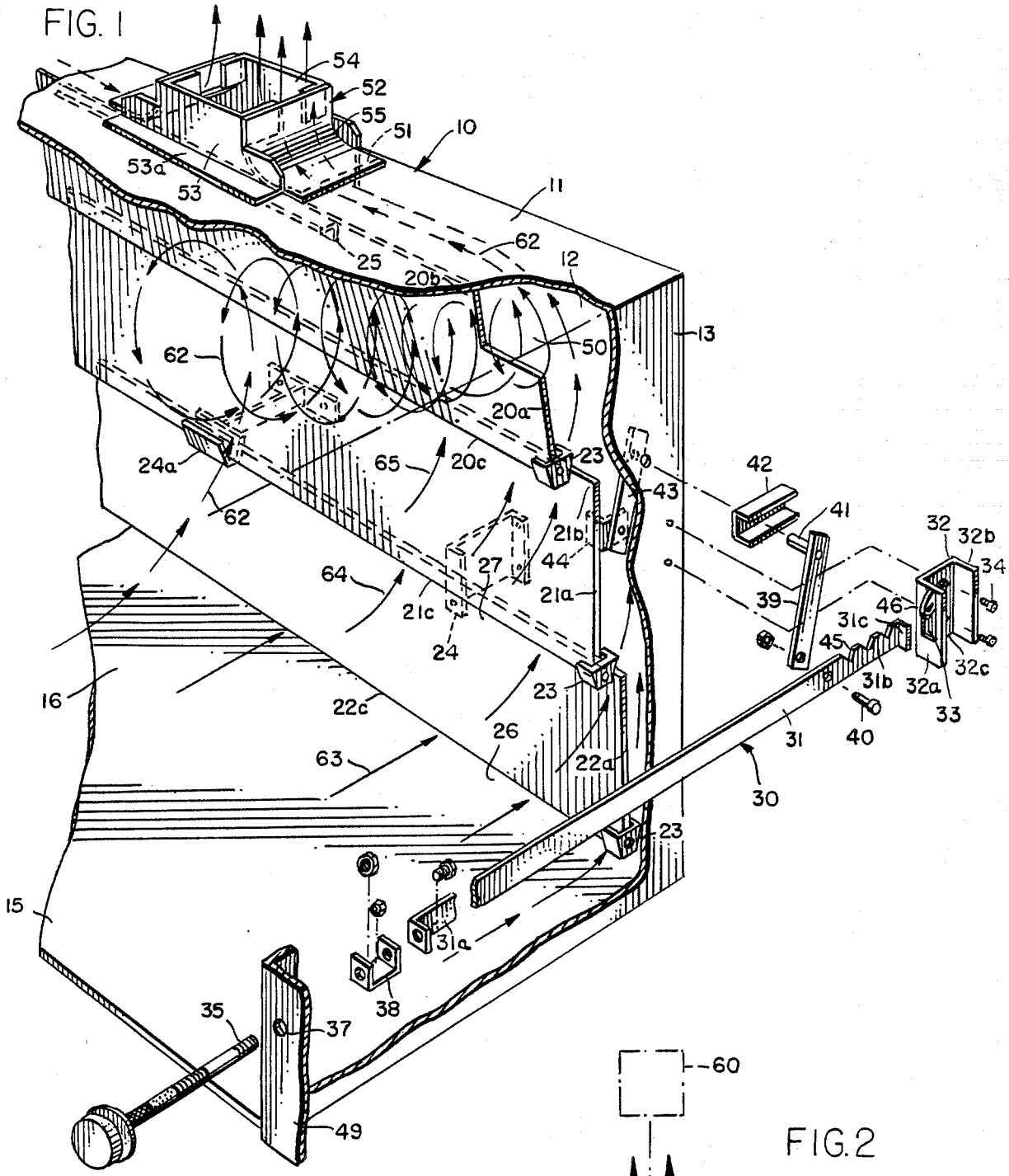
FIG. 1 is a fragmentary perspective view of a fume hood embodying this invention, with the operating mechanism being shown in exploded condition.
Figure 6:
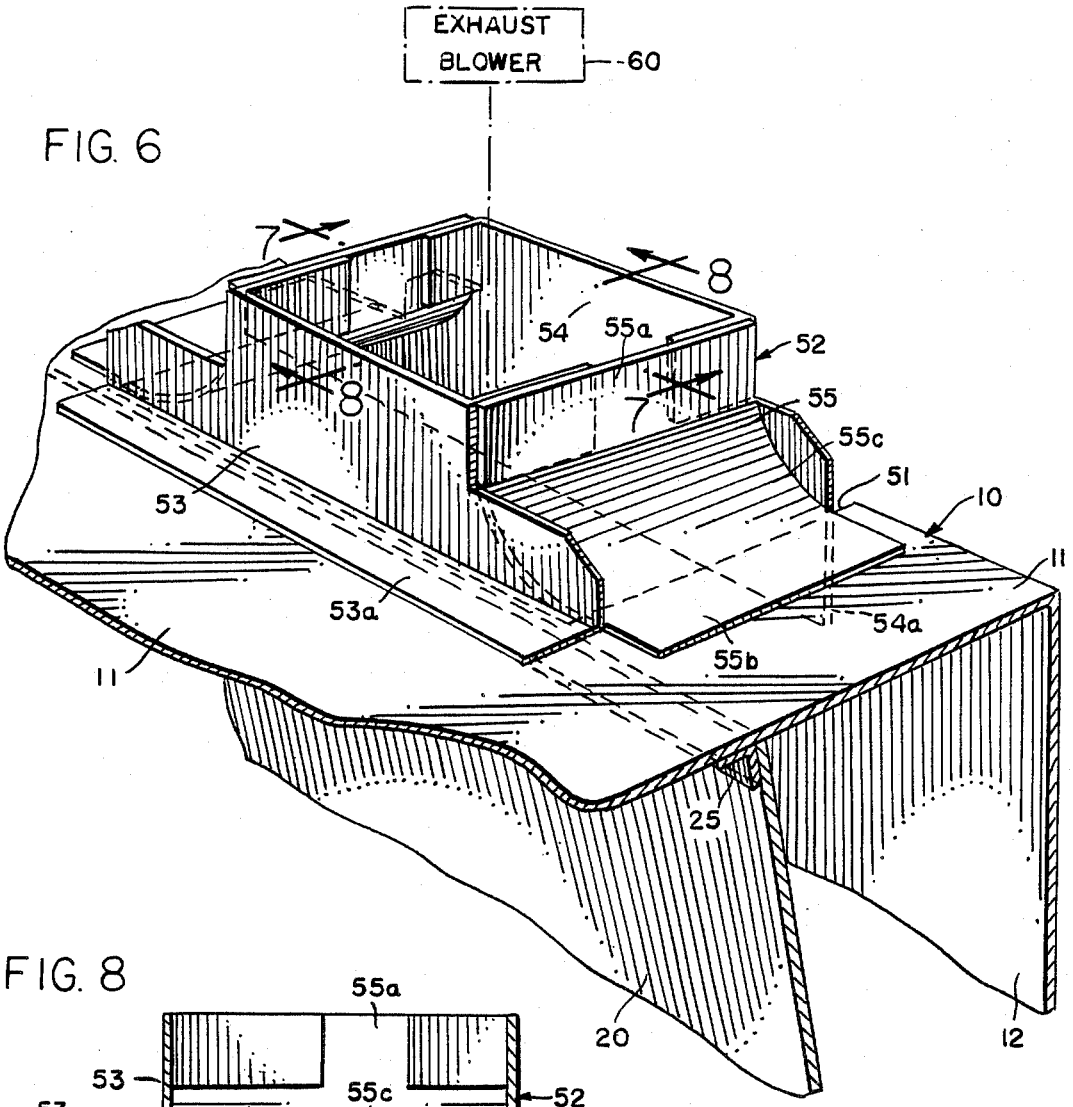
FIG. 6 is a fragmentary perspective view illustrating the bellmouth collar of the fume hood.
Figure 8:
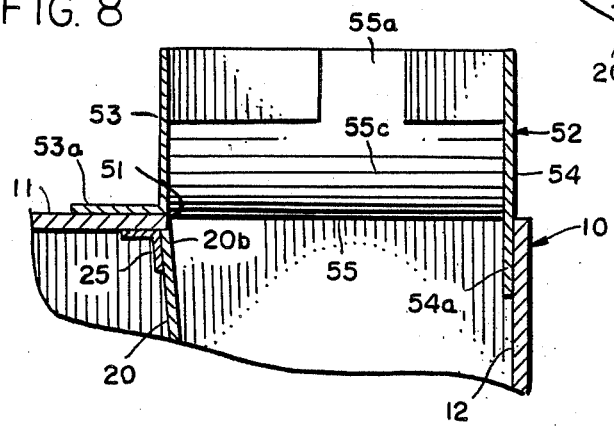
FIG. 8 is a vertical sectional view taken along line 8—8 of FIG. 6.

Upper and lower plates 20 and 22 are fixed in position, assisted in that regard by V-shaped brackets 23 which are secured to the side panels 13 of the hood and which support the respective plates by their lower corners. The upper edge portion **22*b* of the lower baffle plate 22 may be secured to the rear panel 12 by means of a pair of vertically-oriented U-shaped brackets 24 (only one of which is shown in FIG. 1), and the upper edge 20*b* of the upper plate 20 may be affixed to the top panel 11 by bracket 25 (FIGS. 1,6,8) or by any other suitable means. If further bracing of the fixed panels is required, for example, in order to prevent flexing or bowing in operation of the hood, then it is to be understood that additional brackets (not shown) may extend from the lower mid portions of the fixed upper and lower baffles to rear panel 12. It is to be noted that the bottom edge 22*c* of the lower baffle plate 22 is spaced above work surface 15, that the top edge of the upper baffle plate 20 is preferably in direct sealing contact with the undersurface of the top panel 11, and that the baffle plates of the series are stepped or spaced progressively further away from the rear panel 12 so that horizontal slots for the flow of exhaust gases are provided between the upper edges of the baffle plates (except for the uppermost plate) and the lower edges of the plates directly thereabove. A lower horizontal slot or opening 26 therefore extends between the bottom edge of the lower baffle plate and work surface 15, an intermediate slot 27 extends between the top edge 22*b* of the lower baffle plate and the bottom edge 21*c* of the intermediate baffle plate, and an upper slot 28 may exist (depending on the angular adjustment of the intermediate plate) between the top edge 21*b* of the intermediate baffle plate and the lower edge 20*c* of the top baffle plate (FIGS. 3,4**).

FIGS. 3–5 reveal that in a preferred embodiment of the invention the intermediate baffle plate 21 is adjustable between a closed position (FIG. 3), a partially-open position (FIG. 4), and a fully-open position (FIG. 5). The V-shaped brackets 23 that support the lower corners of the intermediate baffle 21, as well as the central bracket **24*a* that supports the lower edge of plate 21 (FIG. 1), permit such limited pivotal adjustment of the intermediate plate. FIG. 4 illustrates a normal operating position with even distribution of air through each of the slots under normal operating conditions. Thus, if the intermediate baffle 21 is to be fixed in position rather than adjustable, the fixed location would be the one depicted in FIG. 4. On the other hand, if the intermediate baffle plate is adjustable (as shown), then the closed position of FIG. 3 is used to provide increased draw along work surface 15, especially where heavier-than-air fumes are involved, and the fully-open position of FIG. 5 is used to provide increased draw at the top slot 28** for exhausting lighter-than-air gases from the hood.

Adjustment of the intermediate baffle plate is preferably achieved by means of a remote-control baffle adjuster assembly generally designated by the numeral 30. The assembly includes a generally horizontal control bar 31 disposed externally of one of the side panels 13 of housing 10. (The assembly may be concealed, if desired, by an outer side panel, not shown, spaced outwardly from side panel 13.) The rear end of the bar is supported by a bracket 32 of generally U-shaped horizontal section, the bracket including front wall **32*a*, rear wall 32*b*, and intermediate wall 32*c*. An aperture 33 in the front wall slidably receives the rear end portion 31*b* of the control bar and the rear wall 32*b* advantageously functions as a stop to limit the extent of rearward sliding movement of the bar. Forward sliding movement is limited by front wall 32*a* and its engagement with laterally-turned terminal portion 31*c* of the bar. The intermediate wall 32*c* is secured to side panel 13 by screws 34** or by any other suitable means.

At its front end **31*a*, the control bar is connected to an actuating member in the form of a control rod 35 equipped at its forward end with a knob 36. The rod extends through aperture 37 in the front of the housing and is threadedly connected at its rear end either directly to the front end 31*a* of the control bar or to a U-shaped coupling 38 which in turn is connected to the control bar's front end. A particular advantage of utilizing a coupling 38 is that the baffle adjuster assembly 30** may be readily adapted for use with fume hoods of different depths simply by interchanging couplings of different horizontal dimensions.

Near its rear end **31*b*, the control bar is pivotally connected to a control arm or link 39. Connecting pin 40 extends through aligned apertures in the bar and in the lower end of the control arm to provide such pivotal connection. At its upper end, the control arm 39 is provided with a pivot pin 41 that extends through aligned apertures in a mounting bracket 42 and in side panel 13, with the inner end of the pivot pin being secured to the upper end of a second control arm 43 disposed within the chamber 16 of the hood alongside the inner surface of side panel 13 (FIG. 1). The lower end of this second control arm is pivotally connected to a connecting member 44 affixed to the rear surface of the intermediate baffle plate 21 at a point spaced well above the lower edge 21*c*** of that plate.

Forward and rearward movement of control knob 36 therefore results in forward and rearward pivotal movement of control arms 39 and 43 about the axis of pivot pin 41, causing the intermediate plate 21 to pivot between the closed and opened positions depicted in FIGS. 3–5. FIGS. 3A–5A illustrate the condition of the baffle adjuster assembly 30 in each of the three positions of adjustment of the intermediate baffle plate. To latch the plate in each of those positions, as well as to provide tactile feedback to the operator when the plate is in each of its selected positions, a series of spaced notches or indentations 45 is provided along the upper surface of the control bar 31 adjacent the rear end 31*b* thereof. A roller catch 46 mounted on bracket 32 above aperture 33 has its spring-loaded roller bearing against the upper rear surface of the control bar to produce a detent action when the roller is received in any of the notches.

Figure 5A:
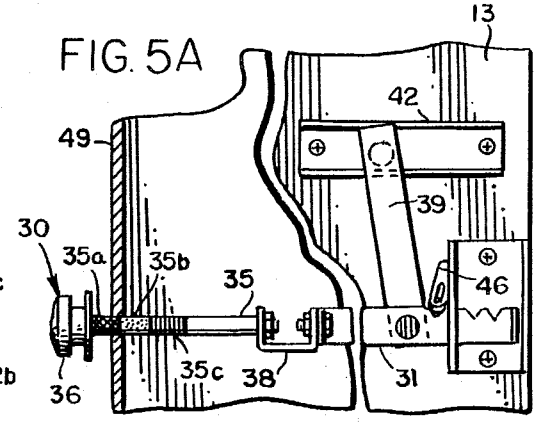
FIG. 5A illustrates the control mechanism when the intermediate baffle plate is in the position shown in FIG. 5.
Figure 4A:
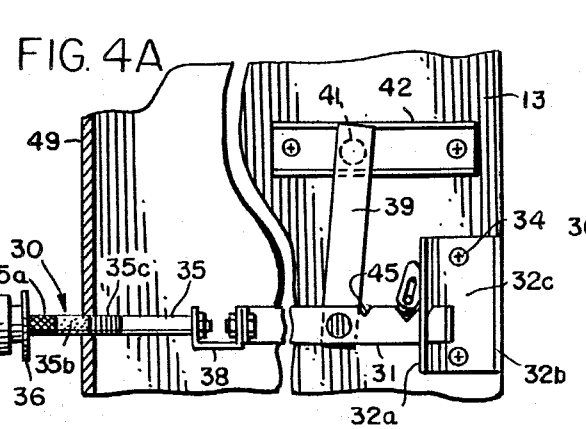
FIG. 4A is similar to FIG. 3A but shows the condition of the control mechanism when the intermediate baffle plate is in the position of FIG. 4.
Figure 3A:
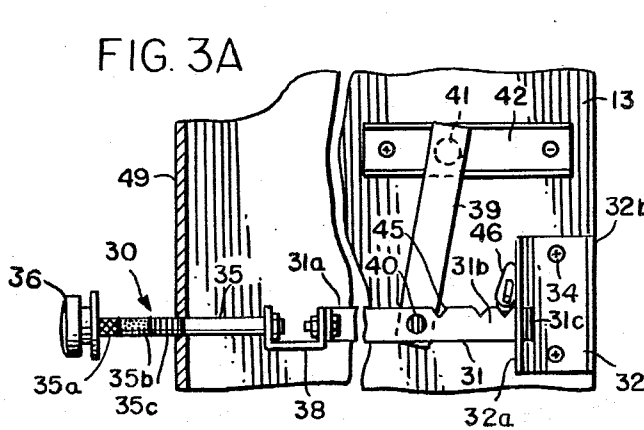
FIG. 3A is a fragmentary view of the control mechanism showing that mechanism when the intermediate baffle plate is in the position of FIG. 3.

It will be observed from FIG. 5A that knob 36 is spaced well in front of the front flange 49 of side panel 13 even when the control bar 31 has been urged rearwardly (i.e., towards the hood) to its fullest extent. Specifically, a first section 35*a* of the control rod 35 is exposed in front of flange 49 when the knob is adjusted to shift the intermediate baffle plate 21 into its fully-opened (FIG. 5) position. When knob 36 is pulled forwardly into an intermediate position to shift the baffle plate into its normal upright position (FIG. 4), a second section 35*b* of the control rod is also exposed (FIG. 4A). Finally, when the control knob 36 is shifted forwardly to its fullest extent, a third section 35*c* of the control rod is also exposed (FIG. 3A). Under those circumstances, the intermediate baffle plate 21 is in its closed position (FIG. 3).

The three sections 35*a*–35*c* of the control rod are color coded with three sharply-contrasting colors such as, for example, yellow, green, and blue, respectively. Such coding may be applied in any suitable manner such as, for instance, by permanently securing a color-imprinted sleeve or band to the rod's cylindrical surface. When the intermediate baffle plate 21 is adjusted so that the upper slot 28 is fully open, only the yellow portion of the band is visible to the operator; when the slot is partially open (the normal position of adjustment of plate 21), the green portion of the band is also visible (FIGS. 4 and 4A); and when the slot is fully closed the blue portion of the band may also be viewed by the operator (FIGS. 3 and 3A). The different shading applied to the respective sections 35*a*–35*c* in FIGS. 3A–5A is intended to indicate the contrasting colors of those sections. By reason of such color coding, an operator may therefore easily and quickly determine, at a point remote from the adjustable baffle 21, the position of adjustment of that baffle.

Figure 2:
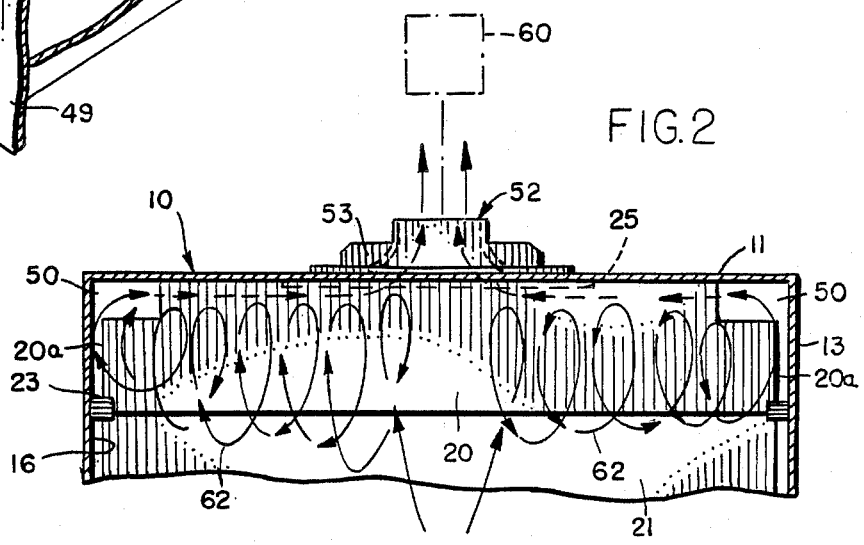
FIG. 2 is a transverse vertical sectional view of the upper portion of the hood illustrating the laterally-directed vortices generated during hood operation.

Referring to FIGS. 1 and 2, the upper baffle plate 20 is cut away at its upper corners to define openings or ports 50 for the flow of exhaust gases from the upper portion of the hood chamber to a rectangular exhaust opening 51 formed as a rectangular notch at a midpoint along the rear of top panel 11. The forward-rearward dimension of opening 51 is substantially the same as the distance between upper baffle plate 20 and rear panel 12, and a generally rectangular exhaust collar 52 is secured to the upper surface of top panel 11 about exhaust opening 51.

Figure 7:
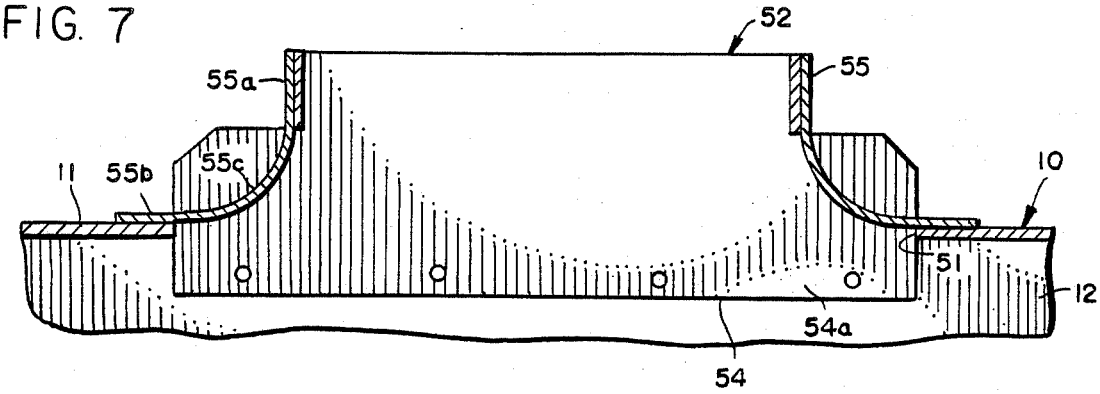
FIG. 7 is a vertical sectional view taken along line 7—7 of FIG. 6.

Exhaust collar 52 has planar front and rear walls 53 and 54 and arcuate side walls 55. As shown most clearly in FIG. 8, the front and rear walls of the exhaust collar are in generally vertical alignment with upper baffle plate 20 and rear panel 12 of the housing 10. The front wall 53 has a forwardly-extending flange 53*a* that rests directly on top panel 11 and may be secured thereto by bolts or by any other suitable connecting means (not shown). Rear wall 54 includes a depending extension 54*a* that extends downwardly through exhaust opening 51 along the inner surface of rear panel 12, the extension also being secured to the rear panel by bolts or other appropriate attachment means. The arcuate side walls 55 have vertical upper portions 55*a*, horizontal lower portions 55*b*, and downwardly and outwardly curved intermediate portions 55*c*. As depicted in FIG. 7, the intermediate portions curve downwardly and outwardly to provide the collar with a bellmouth shape when viewed in vertical transverse section. The horizontal lower portions 55*b* of the side walls overlie top panel 11 just beyond the lateral limits of exhaust opening 51 and are secured to the top panel in the same manner as flange 53*a*. Because of the interfitting relationship between the bellmouth collar and the hood housing, and because of the rectangular configuration of collar 52, opening 51, and the formation of that opening as a rectangular notch in top panel 11, a highly effective interconnection is formed between the collar and the housing. The cement-composition board materials commonly used in hood construction are not highly resistant to impact forces, and it has been found that such a construction avoids problems of breakage that might otherwise occur if the exhaust opening were circular and also positioned closely to the rear edge of top panel 11. The front and rear walls of the collar, being aligned with the upper baffle plate 20 and rear panel 12, permit nearly vertical orientation of the upper baffle plate, thereby providing substantially greater work space in the upper portion of the hood chamber than would otherwise be possible. Of particular importance is the fact that such construction promotes a smooth inward and upward flow of exhaust gases in the space behind upper baffle plate 20, such flow traveling inwardly and then upwardly in directions generally parallel with the planes of baffle plate 20 and rear panel 12.

It is to be understood that a suitable exhaust conduit (not shown) would be connected to the upstanding collar 52 and that an exhaust blower 60 would be mounted in that conduit for exhausting gases from the fume hood. During operation of the hood, exhaust gases in the upper portion of the chamber 16 flow rearwardly, upwardly along upper baffle plate 20, forwardly along the underside of top panel 11, and then downwardly along the front wall of the hood. The rolling action is given lateral direction and control by exhaust ports 50 and exhaust opening 51, all disposed well above the hood's inlet opening 17, and also by the side slots that may be provided between the side edges 20*a* of the upper baffle plate and the side panels 13 of the hood housing. The result is a controlled vortical action represented by arrows 62 in FIGS. 1, 2, and 4. The spiral flow is in laterally outward directions with the gases finally passing through ports 50 (and also about the side edges 20*a* of the upper baffle plate if those edges are spaced from the side panels 13 of the hood) and then traveling horizontally inwardly towards exhaust opening 51 and collar 52 (FIG. 2). Such a construction and its operation result in a predetermined, directed flow of exhaust gases within the upper portion of the hood, reducing the uncontrolled turbulence that might otherwise occur in such a location. Because of such controlled vortical flow, the evacuation of fumes from the upper portion of the hood chamber is significantly enhanced.

FIG. 4 depicts operation of the hood during normal setting of intermediate baffle plate 21. Exhaust gases are drawn through lower slot 26, intermediate slot 27, and upper slot 28, as well as through exhaust ports 50 and the side slots, if they are provided, along the side edges of the baffle plates. Air drawn through inlet opening 17 travels across work surface 15 in the direction of arrows 63. At a higher level, air travels through the chamber and exhausts through intermediate slot 27 (arrows 64) and, at a still higher elevation, rearward flowing air exhausts through upper slot 28 (arrows 65). Under normal operating conditions, the outflow of air through the lower, intermediate, and upper slots 26–28 tends to be equalized and is generally uniform.

In that laboratory work where the generated fumes are heavier than air, the upper slot 28 may be closed (FIG. 3). Greater volumes of air sweep across work surface 15 as indicated by heavy arrows 63. In the upper portion of the hood, the vortical action is increased, producing tight and fast-moving laterally-directed cyclones that aid in evacuating fumes from the upper portion of the hood.

When the gases generated by the laboratory work are lighter than air, the intermediate baffle plate 21 may be adjusted to open slot 28 to its fullest extent (FIG. 5). A greater proportion of fresh air sweeps across the mid-portion of the chamber and is exhausted through slot 28 as represented by arrows 65. Even under such conditions, a substantial amount of air is drawn across work surface 15 in the direction of arrows 63. In the uppermost portion of the chamber, the vortical flow 62 is augmented by the flow represented by arrows 65 so that some portion of the gases that might otherwise flow through the exhaust ports 50 is drawn through upper slot 28. The result is cyclone action of greater reach or radius, with some fumes being exhausted through ports 50 but the greater volume passing through upper outlet slot 28.

While in the foregoing we have disclosed embodiments of this invention in considerable detail for purposes of illustration, it will be understood by those skilled in the art that many of these details may be varied without departing from the spirit and scope of the invention.

We claim:

1. A fume hood having top, front, side and rear panels defining a chamber, a horizontal work surface within said chamber, means defining an exhaust opening in said top panel, an inlet opening beneath said front panel, and a baffle system, for directing gases in said chamber to said exhaust opening; said baffle system including upper, lower, and intermediate baffle plates of generally rectangular outline arranged in a vertical series with upper and lower edges thereof spaced apart to define horizontal exhaust slots for the flow of gases from said chamber to said exhaust opening; wherein the improvement comprises said upper baffle plate being generally vertically disposed and being fixed in position with its upper edge extending along aid to panel between said exhaust opening and aid front panel and with its side edges disposed adjacent said side panels of said hood; said exhaust opening being rectangular in shape with its forward limits extending along the upper edge of said upper baffle plate and with its rearward limits extending along the vertical plane of said rear panel; and blower means communicating with said exhaust opening for drawing gases from said chamber into said exhaust opening; said means defining said exhaust opening including an exhaust collar mounted upon said top panel and having front, rear, and side walls; said front and rear walls being planar and being generally vertically aligned with said upper baffle plate and said rear panel, respectively; said side walls of said exhaust collar having upper, intermediate, and lower portions; said upper portions extending generally vertically, said intermediate portions curving downwardly and outwardly, and said lower portions extending generally horizontally and engaging said top panel on opposite sides of said exhaust opening, whereby, in vertical transverse section said rectangular exhaust collar is of bellmouth configuration.

2. The fume hood of claim 1 in which said rear wall of said collar extends downwardly below the lower portions of said side walls and is secured to said rear panel of said housing.

3. The fume hood of claim 1 in which said front wall is provided with a horizontal flange in contact with the upper surface of said top panel.

4. A fume hood having top, front, side and rear panels defining a chamber, a horizontal work surface within said chamber, means defining an exhaust opening in said top panel, an inlet opening beneath said front panel, and a baffle system for directing gases in said chamber to said exhaust opening; said baffle system including upper, lower, and intermediate baffle plates of generally rectangular outline arranged in a vertical series with upper and lower edges thereof spaced apart to define horizontal exhaust slots for the flow of gases from said chamber to said exhaust opening; wherein the improvement comprises said upper baffle plate being generally vertically disposed and being fixed in position with its upper edge extending along said top panel between said exhaust opening and said front panel and with its side edges disposed adjacent said side panels of said hood; said exhaust opening being rectangular in shape with its forward limits extending along the upper edge of said upper baffle plate and its rearward limits extending along the vertical plane of said rear panel; said lower baffle plate being generally vertically disposed and being fixed in position with its lower edge spaced above said work surface and its upper edge spaced rearwardly with respect to said intermediate baffle plate to define a continuously open slot beneath said lower baffle plate for the flow of gases from said chamber to said exhaust opening; said intermediate baffle plate having an upper edge disposed rearwardly with respect to said upper baffle plate; whereby, said lower, intermediate, and upper plates are stepped progressively further away from said rear panel, respectively; said intermediate baffle plate being pivotally supported for limited pivotal movement about a pivot line extending along its lower edge for adjusting the size of the exhaust slot between the upper edge of said intermediate baffle plate and the lower edge of said upper baffle plate; said intermediate baffle plate being adjustable between a closed position wherein the upper edge of said intermediate baffle plate is disposed adjacent the lower edge of said upper baffle plate and a fully open position wherein said upper edge of said intermediate baffle plate is spaced form both said lower edge of said upper baffle plate and said rear panel of said hood; means for pivotally adjusting said intermediate baffle plate; and blower means communicating with said exhaust opening for drawing gases from said chamber into said exhaust opening.

5. The fume hood of claim 4 in which said means for pivotally adjusting said intermediate baffle plate comprises a generally horizontal control bar extending along one of said side panels of said housing; means supporting said bar for limited forward and rearward movement; a control rod connected to said bar and projecting varying distances from said housing when said bar is shifted forwardly and rearwardly; a knob mounted on said rod; link means operatively connecting said bar with said intermediate baffle plate for pivoting said baffle plate as said bar is shifted forwardly and rearwardly; and color-coded indicia on said rod adjacent said knob for indicating the position of adjustment of said intermediate baffle plate.

6. The fume hood of claim 5 in which said color-coded indicia comprises a plurality of sections of contrasting color arranged in longitudinal series along said rod adjacent said knob; and means provided by said housing for successively revealing or concealing said color-coded sections as said knob is manipulated to shift said bar forwardly or rearwardly, respectively, in adjusting the position of said intermediate baffle plate.

7. The fume hood of claim 5 in which said means for pivotally adjusting said intermediate baffle plate includes detent means engagable with said control bar for restraining said bar at different selected positions of adjustment of said intermediate baffle plate.

8. A fume hood having top, front, side and rear panels defining a chamber, a horizontal work surface within said chamber, means defining an exhaust opening in said top panel, an inlet opening beneath said front panel, and a baffle system for directing gases in said chamber to said exhaust opening; said baffle system including upper, lower, and intermediate baffle plates of generally rectangular outline arranged in vertical series with upper and lower edges thereof spaced apart to define horizontal exhaust slots for the flow of gases from said chamber to said exhaust opening; wherein the improvement comprises said upper baffle plate being generally vertically disposed and being fixed in position with its upper edge extending along said top panel between said exhaust opening and said front panel and with its side edges disposed adjacent said side panels of said hood; said exhaust opening being rectangular in shape with its forward limits extending along the upper edge of said upper baffle plate and with its rearward limits extending along the vertical plane of said rear panel; and blower means communicating with said exhaust opening for drawing gases from said chamber into said exhaust opening; and a pair of vortex-controlling flow ports being provided at the upper corners of said upper baffle plate for causing gases entering said chamber through said inlet opening to travel in laterally and outwardly-directed spiral paths through said ports towards said exhaust opening when said blower means is operating.

9. The fume hood of claim 8 in which said upper baffle plate is disposed above the level of said inlet opening.

10. The fume hood of claim 8 in which said side edges of said upper baffle plate are spaced from said side panels of said housing.

11. The fume hood of claim 8 in which said upper corners of said upper baffle plate are notched to define said vortex-controlling flow ports.

12. A fume hood having top, front, side and rear panels defining a chamber, a horizontal work surface within said chamber, means defining an exhaust opening in said top panel, an inlet opening beneath said front panel, and a baffle system for directing gases in said chamber to said exhaust opening; said baffle system including upper, lower, and intermediate baffle plates of generally rectangular outline arranged in a vertical series with upper and lower edges thereof spaced apart to define horizontal exhaust slots for the flow of gases from said chamber to said exhaust opening; wherein the improvement comprises said upper baffle plate having its upper edge extending along said top panel between said exhaust opening and said front wall and having side edges disposed adjacent the side panels of said housing; blower means communicating with said exhaust opening for drawing gases from said chamber into said exhaust opening; and a pair of vortex-controlling flow ports provided at the upper corners of said upper baffle plate for causing gases entering said chamber through said inlet opening to travel in laterally and outwardly-directed spiral paths through said ports towards said exhaust opening when said blower means is operating.

13. The fume hood of claim 12 in which said upper baffle plate is disposed above the level of said inlet opening.

14. The fume hood of claim 12 in which said side edges of said upper baffle plate are spaced from said side panels of said housing.

15. The fume hood of claim 12 in which said upper corners of said upper baffle plate are notched to define said vortex-controlling flow ports.

16. The fume hood of claim 12 in which said upper and lower baffle plates are fixed in position within said chamber.

17. The fume hood of claim 12 in which said exhaust opening is located equidistant from said side panels and along the rear limits of said top panel.

18. The fume hood of claim 17 in which said exhaust opening extends from said rear panel to said upper baffle plate.

19. The fume hood of claim 12 in which said intermediate baffle plate is pivotally supported for limited pivotal movement about a pivot line extending along its lower edge for adjusting the size of the exhaust slot between the upper edge of said intermediate baffle plate and the lower edge of said upper baffle plate; and means for pivotally adjusting said intermediate baffle plate.

20. The fume hood of claim 19 in which said means for pivotally adjusting said intermediate baffle plate comprises a generally horizontal control bar extending along one of said side panels of said housing; means supporting said bar for limited forward and rearward movement; a control rod connected to said bar and projecting varying distances from said housing when said bar is shifted forwardly and rearwardly; a knob mounted on said rod; link means operatively connecting said bar with said intermediate baffle plate for pivoting said baffle plate as said bar is shifted forwardly and rearwardly; and color-coded indicia on said rod adjacent said knob for indicating the position of adjustment of said intermediate baffle plate.

21. The fume hood of claim 20 in which said color-coded indicia comprises a plurality of sections of contrasting color arranged in longitudinal series along said rod adjacent said knob; and means provided by said housing for successively revealing or concealing said color-coded sections as said knob is manipulated to shift said bar forwardly or rearwardly, respectively, in adjusting the position of said intermediate baffle plate.

22. The fume hood of claim 19 in which said means for pivotally adjusting said intermediate baffle plate includes detent means engagable with said control bar for restraining said bar at different selected positions of adjustment of said intermediate baffle plate.

23. The fume hood of claim 12 in which said means defining said exhaust opening includes an exhaust collar mounted upon said top panel and having front, rear, and side walls; said front and rear walls being planar and being generally vertically aligned with said upper baffle plate and said rear panel, respectively.

24. The fume hood of claim 23 in which said side walls of said exhaust collar have upper, intermediate, and lower portions; said upper portions extending generally vertically, said intermediate portions curving downwardly and outwardly, and said lower portions extending generally horizontally and engaging said top panel on opposite sides of said exhaust opening, whereby, in vertical transverse section said rectangular exhaust collar is of bellmouth configuration.

25. The fume hood of claim 24 in which said rear wall of said collar extends downwardly below the lower portions of said side walls and is secured to said rear panel of said housing.

26. The fume hood of claim 24 in which said front wall is provided with a horizontal flange in contact with the upper surface of said top panel.

27. The fume hood of claim 12 in which said upper baffle plate is planar and extends generally vertically.

* * * * *